United States Patent [19]

D'Amato

[11] 4,253,806

[45] Mar. 3, 1981

[54] LOW SPEED HYDRAULIC MOTOR WITH COUNTER BALANCED PLANETATING DRIVE RING AND SPRING BIASED VANES

[75] Inventor: Michael A. D'Amato, Orrville, Ohio

[73] Assignee: Flo-Tork Inc., Orrville, Ohio

[21] Appl. No.: 29,852

[22] Filed: Apr. 13, 1979

[51] Int. Cl.³ ..... F03C 2/00

[52] U.S. Cl. ..... 418/61 R; 418/73; 418/186; 418/267

[58] Field of Search ..... 418/57, 61 R, 71-73, 418/77, 186, 266, 267

[56] References Cited

U.S. PATENT DOCUMENTS

| | | | |
|---|---|---|---|
| 60,995 | 1/1867 | Butterfield | 418/266 |
| 3,918,857 | 11/1975 | Fitzgerald | 418/73 |
| 3,981,641 | 9/1976 | D'Amato | 418/61 R |

*Primary Examiner*—John J. Vrablik

*Attorney, Agent, or Firm*—James H. Littlepage

[57] ABSTRACT

A drive ring for a rotary expansible chamber hydraulic motor has driving gear teeth on its inner periphery and is constrained against other than planetating motion by a series of angularly spaced eccentric bearings rotatably mounted in fixed port plates between which the drive ring is sandwiched. The eccentric bearings are hydorstatically balanced against peak loads with high pressure fluid. Vanes sliding in radial slots in the drive ring are maintained in engagement against a surrounding cylindrical chamber wall by leaf springs whose opposite ends slide in grooves in the port plates.

7 Claims, 3 Drawing Figures

LOW SPEED HYDRAULIC MOTOR WITH COUNTER BALANCED PLANETATING DRIVE RING AND SPRING BIASED VANES

FIELD OF THE INVENTION

Rotary expansible chamber devices, working member has planetating movement, circumferentially working chambers.

PRIOR ART

D'Amato U.S. Pat. No. 3,981,641.

OBJECTS

The motor which this invention improves is disclosed in my prior U.S. Pat. No. 3,981,641, the essential changes being in the hydrostatic balance of the bearings which constrain the drive ring, and the means for holding the outer ends of the radially sliding vanes against the surrounding cylindrical chamber wall of the casing, plus minor revisions in the locations of certain ports to accommodate these changes.

In the hydraulic motor of the type disclosed in my prior patent (supra), there are a plurality of working chambers separated by vanes which slide radially in a planetating drive ring. Peak loads are imposed serially upon the eccentric bearings which constrain the drive ring against other than planetating movement, and these loads are not distributed uniformly between the several bearings. On the contrary, the bearings on the contracting-chamber side of the drive ring are the ones against which the major portions of the forces tending to rotate the drive ring are imposed. At any given time, when the working chambers on one side of the drive ring see the high-pressure fluid which expands them and drives the ring, the chambers on the contracting-chamber side of the drive ring are vented to low pressure. This high-pressure-low-pressure relationship between the opposite working chambers shifts around the planetating drive ring with each orbit thereof, and hence the peak bearing loads shift from bearing to bearing around the ring. One object of this invention is to provide for hydrostatically balancing those of the eccentric bearing members upon which the peak loads are imposed. More specifically, it is intended to provide in the drive ring a plurality of ducts leading from that side of the drive ring which is disposed towards the high-pressure side of the motor, these ducts leading to the bores in which the eccentric bearings rotate; and further to provide ports in the port plates on that side of the motor which sees high pressure, with which ports the individual ducts register when the major lobes of the eccentric bearings with which they are associated are disposed in opposition to the forces which tend to rotate the drive ring. Because the motor is hydraulically reversible, the hydrostatic balancing fluid is supplied appropriately to the eccentric bearings regardless of which direction the motor rotates.

In the motor disclosed in my prior patent (supra), high-pressure fluid and annular springy bearing rings were used to force the vanes in the drive ring radially outward against the surrounding cylindrical wall of the chamber. While this arrangement had certain virtues, it also entailed certain problems, among them the breaking of the annular bearing rings. This invention encompasses superior means for holding the vanes in engagement with the surrounding cylindrical chamber wall of the casing, namely, leaf springs which lie behind the vanes and which extend from side to side through the drive ring, and whose ends are retained in grooves in the inner faces of the port plates between which the drive ring is sandwiched. The grooves are curved along arcs of the radius of the cylindrical fluid chamber wall of the casing so that, as the drive ring planetates, the leaf springs undergo only slight back and forth movements in the grooves in which they are retained; that is to say, the leaf springs partake of only those portions of the planetating movement of the drive ring which are in the circumferential direction of the cylindrical chamber wall of the casing; and because the inner ends of the vanes are always equi-distant radially inward of the cylindrical chamber wall, the leaf springs undergo virtually no flexing movements. Thus, they are not subject to the fatigue which would result if the springs were engaged between the drive ring and the vanes. High pressure fluid is also used to bias the vanes outwardly and to ensure lubrication of the sliding vanes.

These and other objects will be apparent from the following specification and drawings in which.

Figure 1:
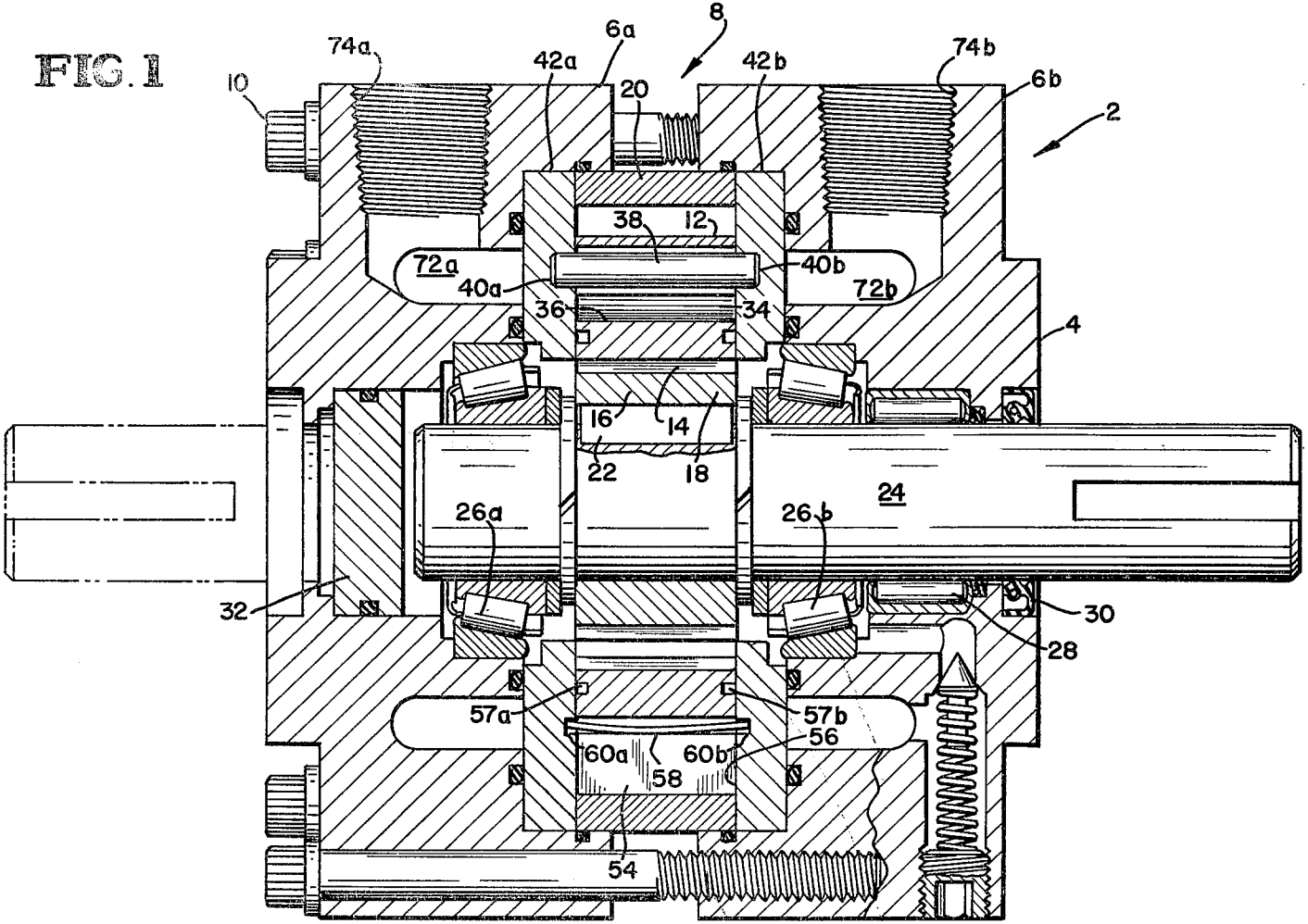
FIG. 1 is a cross section through the motor.

Referring now to the drawings in which like reference numerals denote similar elements, the motor 2 has a casing 4 consisting of two lobes **6*a* and 6*b* sandwiched between them is a central structure 8. These parts are clamped together by through bolts 10. Since the lobes are identical, the suffixes "a" will be used to designate elements in the left-hand lobe, as seen in FIG. 1, and the suffixes "b" will be applied to corresponding elements on the right-hand lobe. In the central structure is a planetating drive ring 12 having internal teeth 14 which engage, a few at a time, against the external teeth 16 of a pinion. The external teeth 16 on the pinion are two less in number than the internal teeth on the drive ring so that each time the drive ring 12 orbits once, the pinion is advanced two teeth distance. Various reductions can be obtained by increasing the number of teeth difference. As will be hearinafter detailed, a hydraulic coupling between drive ring 12 and the surrounding annular chamber wall 20 causes the drive ring to oscillate. The driven pinion is keyed as at 22 onto an output shaft 24, the latter rotating in bearings 26*a* and 26*b* and 28, respectively, in lobes 6*a* and 6*b*. Suitable seals 30 prevent leakage fluid from escaping along drive shaft 24 and a removable end plug 32 permits the drive shaft 24 to be extended outwardly from lobe 6** if desired.

Drive ring 12 is constrained against other than planetating movement about an orbit by eccentric bearings 34 disposed in cross bores 36 in drive ring 12. Bearings 34 rotate on bearing pins 38 whose ends engage in sockets **40*a*, 40*b* in port plates 42*a* and 42*b*. Five fluid displacement chambers 44, 46, 48, 50 and 52 between the outer periphery of orbiting drive ring 12 and annular chamber wall 20 are defined by sliding vanes 54 engaged in radial slots 56 in the orbiting drive ring 12. High pressure oil ported into the expanding chambers causes the drive ring to orbit and this rotates output shaft 24**.

High pressure fluid is supplied to the inner ends of radial slots 56 through an annular groove 57*a* or 57*b* in drive ring 12 via ports in the port plates and channels, not shown. The annular grooves 57*a* and 57*b* communicating with the inner ends of slots 56 by passages (not shown). This ensures lubrication of the vane slots and equalizes the pressure tending to force the vane inward. Sliding vanes 54 are maintained against the annular chamber 20 by means of leaf springs 58 which extend through the inner ends of vane slots 56 from side to side of the drive ring, and slightly beyond. Leaf springs 58 are slightly bowed outward, as seen in FIG. 1, and their ends engage in arcuate slots 60*a* and 60*b* in port plates 42*a* and 42*b*. The leaf springs undergo virtually no radial movement or flexing, their almost entire movements being back and forth in the circumferential direction of the arcuate grooves.

Figure 2:
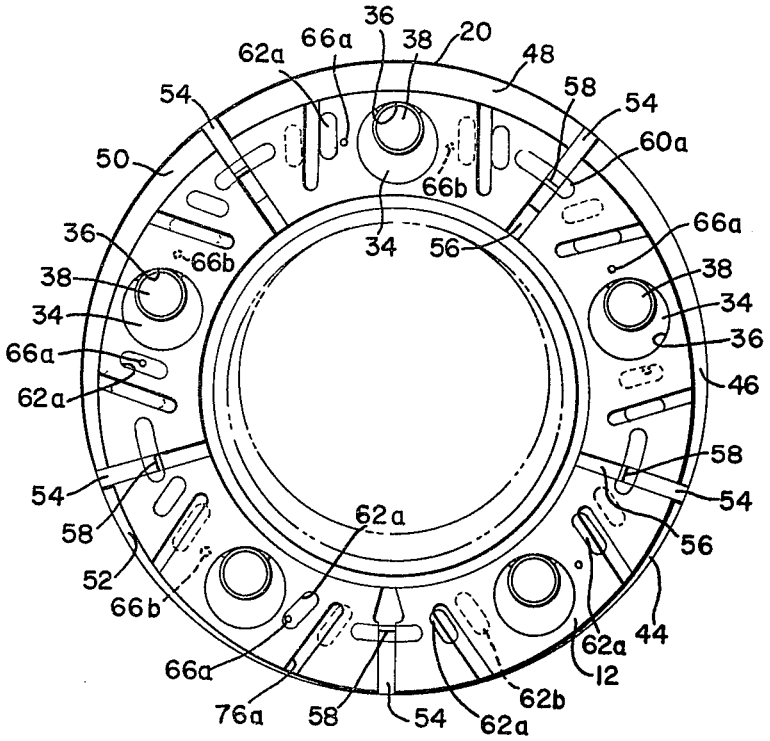
FIG. 2 is a diagrammatic plan view showing the planetating drive ring, sliding vanes, location of the ports in the port plates, leaf springs and ducts for supply of high pressure hydrostatic balance fluid through the eccentric bearings; and, FIG. 3 is a fragmentary cross section in showing an eccentric bearing and adjacent port plate and drive ring structures.
Figure 3:
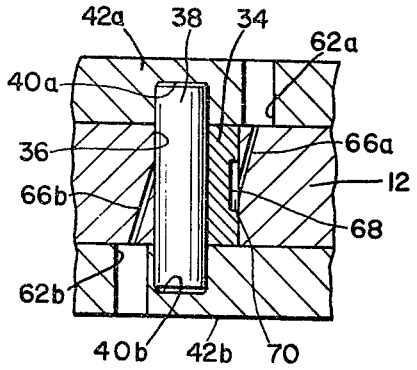

FIG. 2 illustrates the location of the fluid supply and return ports 62*a* and 62*b* on the port plates 42*a* and 42*b* (assuming that port plate 42 is on the high-pressure side of the motor). FIGS. 2 and 3 show the location of ducts 66*a* and 66*b* which lead through the drive ring from each side to about the longitudinal centers of the cross bores 36 in which the eccentric bearings 34 rotate. Eccentric bearings 34 are cut-away on the outer side of the major lobe to provide balancing chamber 70 for hydrostatically balancing the eccentric bearings when they are in the positions in which they withstand the peak loads imposed upon them. In the left-hand side of FIG. 2, it will be apparent that the outer end of a duct 66*a* "sees" a high-pressure port 62*a* when the major lobe of the eccentric bearing has turned so that the hydrostatic balancing chamber 70 registers with the inner end of the duct 66*a*; and at that time the skewed grooves about 180° away "see" ports 62*a*, and working chambers 44 and 46 are being charged with high-pressure fluid. When the eccentric bearing 34 rotates to a position 180° from that shown in FIG. 3, the cutaway portion 68 on the bearing comes opposite the inner end of duct 66*b* and hence if the motor were reversed so that port plate 42*b* were on the high-pressure side of the motor, then the hydrostatic balancing fluid would be supplied to the balancing chamber 70 so as to balance the major portion of the load then imposed upon the eccentric bearing.

Each lobe 6*a* or 6*b* has an annular chamber 72*a* or 72*b* for service fluid, to which service ports 74*a* and 74*b* are connected.

Except for the action of the leaf springs 58 and the hydrostatic balancing of the eccentric bearings, the operation of the subject motor is similar to that of the motor disclosed in my prior U.S. Pat. 3,981,641. To summarize, assuming service port 74*a* is connected to the high-pressure fluid supply and 74*b* is connected on the return fluid side, high-pressure fluid is supplied through those ports 62*a* which register with certain of skewed grooves 76*a*, and the high-pressure fluid enters those of the fluid displacement chambers 44, 46, 48, 50 or 52 which are then on the "drive" side of the drive ring, and fluid is exhausted to the low-pressure side of the motor via the skewed grooves which lie opposite grooves 76*a* and out through the port 62*b* through the port plate in the low-pressure side of the motor. When the eccentric bearings 34 turn so that the peak loads are imposed thereon, the ducts 66*a* "see" a high-pressure port 62*a* and high-pressure fluid enters the balancing chambers 70 for that bearing, it will be apparent from FIG. 2 that in the cases of those of the eccentric bearings which, at any given time, are not heavily loaded, the ducts 66*a* therefore do not "see" high pressure and hence the hydrostatic balancing forces (which at that time would unbalance the bearings) are not imposed.

As the peak bearing loads proceed sequentially around the drive ring according to its orbital position, the ducts 66*a* associated therewith are sequentially charged with high pressure fluid.

I claim:

1. In a hydraulic motor having a pair of service ports adapted to be connected respectively to high-pressure supply and low-pressure return motive fluid conduits, a planetating drive ring sandwiched between a pair pair of port plates, a gear driven by said drive ring, a plurality of bearing means extending between the port plates and disposed at angularly spaced intervals about said drive ring for constraining the same with respect to the port plates against other than planetating movement about an axis in one orbital direction or the opposite, a fluid chamber wall of closed configuration opposite a periphery of said drive ring, a plurality of vanes angularly spaced about the drive ring periphery and defining between the drive ring and the chamber wall a plurality of expansible-contractile working chambers angularly spaced about the drive ring periphery, and motive fluid control means responsive to the orbital positioning of said drive ring for connecting said working chambers, at least one at a time, in sequence in one circumferential direction or the other to one of said service ports while connecting to the other service port generally oppositely disposed working chambers sequentially in the same direction, whereby motive fluid forces which energize the working chambers impose peak loads sequentially to those sides of the bearing means which are disposed contra to the circumferential direction in which the working chambers are energized, the improvement which comprises means responsive to the orbital positioning of the drive ring for sequentially applying hydrostatic balancing forces to those bearing means which are disposed substantially 180° from the energized working chambers in opposition to the peak loads imposed thereon.

2. A hydraulic motor as claimed in claim 1, said drive ring having opposite side surfaces slidably engaging against inner sides of said port plates respectively, said bearing means being comprised of a plurality of bores extending from side-to-side through said drive ring and being angularly spaced about a circle concentric with the drive ring periphery, cylindrical bodies rotatably engaging in said bores, and eccentric shaft means extending from opposite ends of said cylindrical bodies for rotatably supporting the same between the port plates, the means responsive to orbital position of the drive ring for sequentially applying hydrostatic balancing forces to the bearing means comprising for each bore a duct extending through the drive ring and having an inner end terminating at one side of the bore intermediate the ends thereof and an outer end terminating at one side of the drive ring, and for each duct a port through a port plate past which the outer end of the duct passes for part of each orbit of the drive ring for sequentially connecting the ducts to one of the service ports.

3. A hydraulic motor as claimed in claim 2, said cylindrical bodies each having a cut-away portion in the side thereof which lies opposite the eccentric shaft means, whereby to define between that side of the cylindrical body and the side of the bore a chamber which rotates past the inner end of the duct with each orbit of the drive ring.

4. A hydraulic drive motor having a planetating drive ring sandwiched between two plates, eccentric bearing means mounting said drive ring on said plates for orbital movement about an axis, and a fluid chamber wall surrounding the drive ring, said drive ring having a plurality of angularly sapced vane slots extending from side to side therethrough, a plurality of vanes having inner ends slidably mounted in said vane slots and having free ends slidably engaging against portions of chamber wall, and means for maintaining the outer ends of the vanes engaged against said portion of the chamber wall comprising for each slot an elongate spring extending therethrough in the axial direction of the drive ring, each spring having an intermediate portion engaging against the inner end of the vane in said slot and outer ends engaged in grooves in said port plates which constrain said spring against movement other than along a path parallel to the portion of said chamber engaged by the vane.

5. A hydraulic drive motor having a planetating drive ring sandwiched between two plates, eccentric bearing means mounting said drive ring on said plates for orbital movement about an axis, and a cylindrical fluid chamber wall, said drive ring having a plurality of angularly spaced vane slots extending from side to side therethrough, a plurality of vanes having inner ends slidably mounted in said vane slots and having free ends slidably engaging against the chamber wall, and means for maintaining the outer ends of the vanes engaged against the cylindrical chamber wall comprising for each slot an elongate spring extending therethrough in the axial direction of the drive ring, each spring having an intermediate portion engaging against the inner end of the vane in said slot and outer ends engaged in grooves in said port plates which constrain said springs against movement other than along arcs of a circle concentric with said cylindrical chamber wall.

6. A hydraulic motor as claimed in claim 5, the lengths of said grooves being slightly more than twice the eccentricity of said bearing means.

7. In hydraulic motor as claimed in claim 5, means for charging inner ends of the vane slots with hydraulic fluid, and said grooves extending across said vane slots whereby said hydraulic fluid lubricates the springs.

* * * * *

UNITED STATES PATENT AND TRADEMARK OFFICE

CERTIFICATE OF CORRECTION

PATENT NO. : 4,253,806
DATED : March 3, 1981
INVENTOR(S) : Michael A. D'Amato

It is certified that error appears in the above—identified patent and that said Letters Patent is hereby corrected as shown below:

In the Abstract, line 6, delete "hydor-",
insert -- hydro- --.

In column 4, line 12, delete "pair";

line 27, delete "contractile",
insert --contractible--.

In column 5, line 14, delete "sapced",
insert --spaced--.

Signed and Sealed this

*Seventh* Day of *July 1981*

[SEAL]

*Attest:*

RENE D. TEGTMEYER

*Attesting Officer*

*Acting Commissioner of Patents and Trademarks*